US010099253B2

(12) United States Patent
Reynolds et al.

(10) Patent No.: US 10,099,253 B2
(45) Date of Patent: Oct. 16, 2018

(54) TRANSDUCER WITH MESA

(71) Applicant: uBeam Inc., Santa Monica, CA (US)

(72) Inventors: Paul Reynolds, Santa Monica, CA (US); Marc Berte, Ashburn, VA (US)

(73) Assignee: uBeam Inc., Marina Del Rey, CA (US)

( * ) Notice: Subject to any disclaimer, the term of this patent is extended or adjusted under 35 U.S.C. 154(b) by 790 days.

(21) Appl. No.: 14/566,518

(22) Filed: Dec. 10, 2014

(65) Prior Publication Data

US 2016/0167090 A1 Jun. 16, 2016

(51) Int. Cl.

| | |
|---|---|
| ***B06B 1/06*** | (2006.01) |
| ***G10K 9/12*** | (2006.01) |
| ***G10K 9/122*** | (2006.01) |

(52) U.S. Cl.

CPC ..... *B06B 1/0603* (2013.01); *G10K 9/121* (2013.01); *G10K 9/122* (2013.01)

(58) Field of Classification Search

CPC ... B06B 1/0603; B06B 1/0618; B06B 1/0622; G10K 9/121; G10K 9/122; H04R 17/00

USPC ..... 310/339, 334, 324

See application file for complete search history.

(56) References Cited

U.S. PATENT DOCUMENTS

| | | | | |
|---|---|---|---|---|
| 3,946,831 | A | 3/1976 | Bouyoucos | |
| 5,198,716 | A | 3/1993 | Godshall et al. | |
| 5,376,221 | A | 12/1994 | Staudte | |
| 5,436,523 | A | 7/1995 | Staudte | |
| 5,517,291 | A | 5/1996 | Montfort et al. | |
| 5,600,880 | A * | 2/1997 | Santini | G11B 5/3163 29/603.14 |
| 6,003,390 | A | 12/1999 | Cousy | |
| 6,037,704 | A | 3/2000 | Welle | |
| 6,127,942 | A | 10/2000 | Welle | |
| 6,479,890 | B1 | 11/2002 | Trieu et al. | |

(Continued)

FOREIGN PATENT DOCUMENTS

| | | |
|---|---|---|
| CN | 102184729 A | 9/2011 |
| EP | 1423685 B1 | 8/2011 |

(Continued)

OTHER PUBLICATIONS

Jiang, et al., "Multi-Channel Indoor Wireless Data Communication Using High-k Capacitive Ultrasonic Transducers in Air", Ultrasonics Symposium (IUS), 2013 IEEE International, Jul. 2013, Prague pp. 1606-1609, ISSN: 1948-5719.

(Continued)

*Primary Examiner* — Bryan Gordon

(74) *Attorney, Agent, or Firm* — Morris & Kamlay LLP

(57) ABSTRACT

An ultrasonic transducer having a container, a base an actuator and a membrane system. The membrane system can include a membrane, a mesa and a standoff. The mesa can be shaped to achieve one or more target frequencies and other target vibrational properties, such as amplitudes. The actuator may be a flexure having one or more electroactive materials, such as piezoelectric and/or electrostrictive materials. The flexure may be fixed at one end to a wall of the container be in communication with the membrane system at or around its other end. The actuator may be in contact with the membrane system through the mesa and/or the standoff. The standoff may include an adhesive filled with beads to achieve a specific thickness.

33 Claims, 4 Drawing Sheets

(56) References Cited

U.S. PATENT DOCUMENTS

| | | | | |
|---|---|---|---|---|
| 6,479,920 | B1 * | 11/2002 | Lal | G21H 1/00 310/309 |
| 6,798,716 | B1 | 9/2004 | Charych | |
| 6,987,348 | B2 | 1/2006 | Buhler et al. | |
| 7,446,456 | B2 | 11/2008 | Maruyama et al. | |
| 7,489,967 | B2 | 2/2009 | Von Arx et al. | |
| 7,490,519 | B2 | 2/2009 | Subramanian et al. | |
| 7,606,621 | B2 | 10/2009 | Brisken et al. | |
| 7,610,092 | B2 | 10/2009 | Cowan et al. | |
| 7,710,002 | B2 | 5/2010 | Horie et al. | |
| 7,902,943 | B2 | 3/2011 | Sherrit et al. | |
| 7,992,271 | B2 | 8/2011 | Mehta | |
| 8,082,041 | B1 | 12/2011 | Radziemski | |
| 8,159,364 | B2 | 4/2012 | Zeine | |
| 8,638,022 | B2 | 1/2014 | Komine et al. | |
| 8,649,875 | B2 | 2/2014 | Sarvazyan | |
| 8,816,567 | B2 | 8/2014 | Zuo et al. | |
| 2001/0035700 | A1 | 11/2001 | Percin et al. | |
| 2003/0020376 | A1 | 1/2003 | Sakaguchi et al. | |
| 2004/0066708 | A1 | 4/2004 | Ogawa | |
| 2004/0130243 | A1 * | 7/2004 | Buhler | H01L 41/0973 310/324 |
| 2004/0146434 | A1 * | 7/2004 | Kane | B01F 3/18 422/534 |
| 2004/0172083 | A1 | 9/2004 | Penner | |
| 2004/0204744 | A1 | 10/2004 | Penner et al. | |
| 2005/0070962 | A1 | 3/2005 | Echt et al. | |
| 2005/0200243 | A1 * | 9/2005 | Spangler | F16F 15/005 310/338 |
| 2005/0207589 | A1 | 9/2005 | Biegelsen | |
| 2007/0109121 | A1 | 5/2007 | Cohen | |
| 2007/0150019 | A1 | 6/2007 | Youker et al. | |
| 2008/0184549 | A1 | 8/2008 | Nguyen-Dinh et al. | |
| 2008/0309452 | A1 | 12/2008 | Zeine | |
| 2010/0027379 | A1 | 2/2010 | Saulnier et al. | |
| 2010/0157019 | A1 | 6/2010 | Schwotzer et al. | |
| 2010/0164433 | A1 | 7/2010 | Janefalkar et al. | |
| 2010/0265976 | A1 * | 10/2010 | Bousquet | H01L 21/02389 372/44.01 |
| 2010/0286744 | A1 | 11/2010 | Echt et al. | |
| 2010/0315045 | A1 | 12/2010 | Zeine | |
| 2012/0128999 | A1 * | 5/2012 | Way | B01D 53/228 428/621 |
| 2012/0299540 | A1 | 11/2012 | Perry | |
| 2012/0299541 | A1 | 11/2012 | Perry | |
| 2012/0299542 | A1 | 11/2012 | Perry | |
| 2012/0300588 | A1 | 11/2012 | Perry | |
| 2012/0300592 | A1 | 11/2012 | Perry | |
| 2012/0300593 | A1 | 11/2012 | Perry | |
| 2012/0320713 | A1 * | 12/2012 | Mueller | G01F 23/296 367/141 |
| 2013/0069865 | A1 | 3/2013 | Hart et al. | |
| 2013/0207604 | A1 | 8/2013 | Zeine | |
| 2013/0239700 | A1 | 9/2013 | Benfield et al. | |
| 2013/0241468 | A1 | 9/2013 | Moshfeghi | |
| 2013/0249353 | A1 | 9/2013 | Naito et al. | |
| 2013/0264663 | A1 | 10/2013 | Dehe et al. | |
| 2013/0271088 | A1 | 10/2013 | Hwang et al. | |
| 2014/0265727 | A1 * | 9/2014 | Berte | B06B 1/0603 310/317 |

FOREIGN PATENT DOCUMENTS

| | | | |
|---|---|---|---|
| GB | 2386028 | A | 9/2003 |
| JP | 07327299 | A | 12/1995 |
| JP | 2002118440 | A | 4/2002 |
| JP | 2007-306389 | | 11/2007 |
| JP | 2008244964 | A | 10/2008 |
| JP | 5435243 | | 12/2013 |
| KR | 10-2009-0118873 | | 12/2009 |
| WO | 2000/21020 | | 4/2000 |
| WO | 2006/069215 | | 6/2006 |
| WO | 2012166583 | A1 | 12/2012 |
| WO | 2013143630 | A1 | 10/2013 |

OTHER PUBLICATIONS

Intemational Search Report and Written Opinion issued in PCT/US2015/064520 dated Feb. 16, 2016.

Bao, et al., "High-power piezoelectric acoustic-electric power feedthru for metal walls", Proceedings of SPIE, vol. 6930, pp. 1-8, 2008.

Bao, et al., "Wireless piezoelectric acoustic-electric power feedthru", Proceedings of SPIE, vol. 6529, pp. 1-7, 2007.

Etherington, "Cota by Ossia Aims to Drive a Wireless Power Revolution and Change How We Think About Charging", Available at: http://techcrunch.com/2013/09/09/cota-by-ossia-wireless-power/. Date visited: Sep. 12, 2013, pp. 1-4, Sep. 9, 2013.

Germano, "Flexure Mode Piezoelectric Transducers", Morgan Electro Ceramics, Technical Publication TP-218. J. Acoust. Soc. Am. vol. 50, Issue 1A, pp. 1-6, 1971.

Intellectual Ventures, "MSA-T", Available at: http://www.intellectualventures.com/index.php/inventions-patents/our-inventions/msa-t. Date visited: Mar. 21, 2013., 2013.

Intellectual Ventures, "MSA-T: Enabling affordable, all-electronic beam steering satcom user terminals", Available at: http://www.intellectualventures.com/assets_docs/IV_metamaterials_technical_overview.pdf. Visited on: Mar. 21, 2013, 2011.

Mobilitywire, "Ossia Unveils World's First Commercially Viable Remote Wireless Power System", Available at: http://www.mobilitywire.com/ossia/2013/09/10/7888. Date visited: Sep. 12, 2013, pp. 1-4, Sep. 10, 2013.

Morgan Electro Ceramics, "Cantilever Mounted PZT 5A Bimorphs", Technical Publication TP-245, pp. 1-8, 1999.

Murray, Susan L., et al., "Effect of mesa-shaping on spurious modes in ZnO/Si bulk-wave composite resonators", Institute of Electrical and Electronics Engineers, 1983, 498-503.

Nam-Trung Nguyen, et al., "Acoustic streaming in micromachined flexural plate wave devices: numerical simulation and experimental verification", IEEE Transactions on Ultrasonics, Ferroelectrics, and Frequency Control (vol. 47, Issue: 6), Nov. 2000, 1463-1471.

S Tadigadapa, et al., "Piezoelectric MEMS sensors: state-of-the-art and perspectives", Measurement Science and Technology vol. 20 No. 9 Meas. Sci. Technol. 20 092001 doi:10.1088/0957-0233120/9/092001, 2009.

Sherrit, et al., "Comparison of the Mason and KLM Equivalent Circuits for Piezoelectric Resonators in the Thickness Mode", IEEE Ultrasonics Symposium, vol. 2, pp. 921-926, 1999.

Sherrit, et al., "Efficient Electromechanical Network Models for Wireless Acoustic-Electric Feed-throughs", Proceedings of the SPIE Smart Structures Conference, vol. 5758, pp. 362-372, Mar. 6-10, 2005.

Sherrit, et al., "Solid Micro Horn Array (SMIHA) for Acoustic Matching", Proceedings of SPIE, vol. 6932, pp. 1-9, 2008.

Sherrit, et al., "Studies of Acoustic-Electric Feed-throughs for Power Transmission Through Structures", Proceedings of SPIE, vol. 6171, pp. 1-8, 2006.

Sherrit, "The Physical Acoustics of Energy Harvesting", IEEE International Ultrasonics Symposium Proceedings, pp. 1046-1055, 2008.

Soeren Hirsch, et al., "A new device with PZT ultrasonic transducers in MEMS technology", Journal of Physics: Conference Series vol. 34; J. Phys.: Conf. Ser. 34 475 doi:10.1088/1742-6596/34/1/078, 2006.

Takashi Abe, et al., "Inverted Mesa-Type Quartz Crystal Resonators Fabricated by Deep-Reactive Ion Etching", IEEE Transactions on Ultrasonics, Ferroelectrics, and Frequency Control, vol. 53, No. 7, Jul. 2006, 1234.

* cited by examiner

TRANSDUCER WITH MESA

BACKGROUND

Ultrasonic transducers receive electrical energy as an input and provide acoustic energy at ultrasonic frequencies as an output, or receive acoustic energy at ultrasonic frequencies as an input and provide electrical energy as an output. An ultrasonic transducer can include a piece of piezoelectric material that changes size in response to the application of an electric field. If the electric field is made to change at a rate comparable to ultrasonic frequencies, then the piezoelectric element can vibrate and generate acoustic pressure waves at ultrasonic frequencies. Likewise, when the piezoelectric element resonates in response to impinging ultrasonic energy, the element can generate electrical energy.

BRIEF SUMMARY

In an implementation, an ultrasonic transducer can include a membrane and a container having a base and at least one wall element. The one or more wall elements can be situated over at least part of the base to form a cavity that can have an at least partially open end. The open end can be sealed with the membrane and the interior of the container can be maintained at a lower, higher or the same atmospheric pressure than the ambient pressure. Within the container, an actuator such as an actuator such as a piezoelectric or electrostrictive flexure can be fixed at one end to a location at a wall element. The other end of the flexure can be in mechanical communication with the membrane, either directly or through one or more elements, such as a mesa and/or a standoff that can be stacked or used separately. The mesa and/or the standoff can be in communication with the membrane.

The flexure can include a substrate, a piezoelectric and/or electrostrictive material and at least one electrode. Any electroactive material or combination of such materials can be used in the flexure. As used herein, the term "electroactive" means any material that changes its shape in any dimension in response to a change in an electric field. Examples of electroactive materials include piezoelectric and electrostrictive materials. The electroactive material(s) may be disposed in one or more layers as part of the flexure. The flexure may include one or more electrodes. In an embodiment of a flexure, a thin film piezoelectric material can be disposed between a substrate and a conductor. The substrate can be made of a conductive material, such as a metal. The substrate can then act as one electrode and the conductor may act as a second electrode. In another embodiment, a substrate may be surrounded on both sides by piezoelectric layers, which in turn can be at least partially covered by conductors. In certain cases, each electroactive material layer can have two electrodes, with an electrode on each opposing side. Where there is more than one electroactive material, each may have two independent electrodes or may share one or more electrodes with other electroactive materials. Further there may be arrangements where each electrode is divided into two or more sections, each with an independent electrical connection.

The ultrasonic transducer can receive an electrical control signal (a "driving signal"), causing the flexure to bend and/or the tip to vibrate relative to its base at or around ultrasonic frequencies. The flexure can be in direct or indirect (e.g., through a mesa and/or a standoff) communication with the membrane and can cause the membrane to vibrate and create ultrasonic frequency acoustic waves.

Additional features, advantages, and implementations of the disclosed subject matter may be set forth or apparent from consideration of the following detailed description, drawings, and claims. Moreover, it is to be understood that both the foregoing summary and the following detailed description provide examples of implementations and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate implementations of the disclosed subject matter and together with the detailed description serve to explain the principles of implementations of the disclosed subject matter. No attempt is made to show structural details in more detail than may be necessary for a fundamental understanding of the disclosed subject matter and various ways in which it may be practiced.

DETAILED DESCRIPTION

Figure 1:
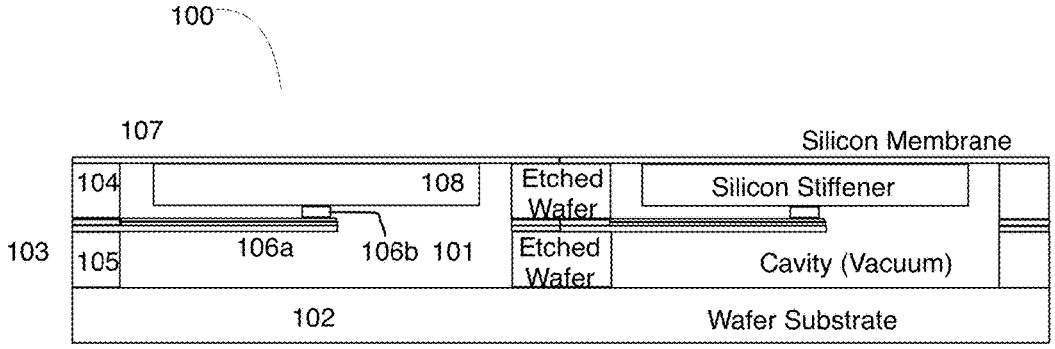
FIG. 1 shows an ultrasonic transducer according to an implementation of the disclosed subject matter.

According to the present disclosure, an ultrasonic transducer can include a membrane, a mesa attached to the membrane and an actuator that is directly or indirectly mechanically linked to (in communication with) the membrane. The actuator may include an electroactive material, such as an electrostrictive material, a piezoelectric material, or a combination of electrostrictive and piezoelectric materials. The actuator may be a flexure. Examples of piezoelectric materials include such as PZT, PMN-PT, PVDF, PZT4, PZT5A, PZT5H and the like. Examples of electrostrictive materials include PMN-Lead Magnesium Niobate, or electrostrictive polymers.

The mesa may be attached to the membrane by being affixed to the membrane, or by being an integral part of the membrane. For example, the mesa may be a separately formed component from the membrane that may be affixed to the membrane using any bonding technique, for example, using an adhesive, a bonding layer, pressure bonding, clips, screws, etc. The mesa may also be formed as an integral part of the membrane by any suitable technique, for example, by etching, laser cutting, deposition (such as physical vapor deposition, including sputter deposition), etc.

In an implementation, the actuator can be a flexure that can be mechanically fixed at one end to a location at a wall of a container. The other end of the flexure may be mechanically linked to a membrane system that may cover all or part of the container. A membrane system can include a membrane alone, a membrane and a mesa, a membrane and a standoff, a membrane with a standoff interposed between the end of the flexure and the mesa, or combinations of other membrane system components. The flexure can be driven by an electrical control signal (a driving signal) to displace the membrane system at or around ultrasonic frequencies, thereby generating ultrasonic waves. The effective stiffness of the flexure may be from 0.1 kN/m to 30.0 MN/m and may have an effective mass of from 0.1 milligrams to 30 milligrams. Some implementations may have an effective stiffness range of 100 kN/m to 1 MN/m and effective mass of 0.4 milligrams to 10 milligrams.

The flexure may be in direct contact with the membrane itself, or the flexure can be mechanically linked to the membrane through the mesa. The mesa can be disposed between the membrane and the flexure or it may be on the other side of the membrane from the flexure, or a combination thereof. One side of the mesa can be in mechanical contact with the membrane and the other side of the mesa can be in mechanical contact with the flexure, either directly or through a standoff or other component(s). For example, the distal end of the flexure may vibrate based on the changing position of the end of the flexure in response to the driving signal. The mesa can improve the resonant properties of the ultrasonic transducer. The particular design of the mesa may change the vibrational properties of the membrane system. Design parameters of the mesa can include the material or materials of which the membrane is made, the mass of mesa, the disposition of mass in the mesa, the geometrical shape of the mesa, and so on. If the mesa is made of more than one material or structure element, then the sizes, shapes and arrangements of the elements can also affect the vibrational properties of the membrane system. The mesa may be purposely designed to cause the membrane-plus-mesa combination move in a predetermined fashion. For example, the mesa may be designed to maximize the average in-phase displacement across the surface. The mesa may also be used to alter the mass of the membrane system. The change in stiffness and mass to the membrane system caused by a particular mesa design can advantageously improve the performance of the system in terms of producing one or more desired frequencies and/or amplitudes of ultrasonic energy.

The membrane may be composed of one kind of material and the mesa may be composed of the same or a different kind of material. Either or both of the membrane and the mesa may be composed of more than one material. For example, the materials may be in the form of an alloy, layered materials or other composite material, such as a carbon composite material having different physical properties such as directional variations in stiffness and extensibility in different directions within the material. Different materials may be used in different regions and in different patterns in the membrane, the mesa, or both. For example, the membrane may be composed of a polymer and the mesa may be composed of a metal, or vice versa. As used herein, the term metal can encompass single metals and alloys.

In some implementations, the membrane may be made of one or more materials including a polymer, including a polyimide such as poly (4,4'-oxydiphenylene-pyromellitimide), also known as Kapton; aluminum; copper; stainless steel or other steels; brass; titanium, Mylar, diamond, sapphire or other materials. For example, the membrane can be made of a polymer, a single crystal material, such as monocrystalline silicon, diamond, or a super-elastic metal alloy such as NiTi.

The mesa can be formed in any suitable pattern, such as an H pattern, a circular shape, an ellipse, a cross, a star, a circle with a cross, a ring of any form, an irregular shape, etc. The mesa may include more than one component. For example, the mesa may include two or more concentric circles. Further, the mesa may be symmetric about a single axis, two axes or three axes, be asymmetric around one or more axes, or be irregularly shaped. The mesa may be made of one or more materials including copper, aluminum; copper; stainless steel; brass; titanium or other materials such as polymers, glasses, single crystals, polycrystalline or composite materials. The thickness of a single mesa or mesa component may be constant or may vary. The mesa may also be in the form of a grid that may cover any suitable amount of the surface area of the membrane. The mesa may be attached to the membrane through the use of any suitable bonding techniques and materials, or may be integral to the membrane, for example, as a result of etching or layer deposition. A portion of the actuator may be in contact with the membrane or mesa at a location substantially corresponding to the center of the membrane or the mesa or both. In some implementations, the actuator may be in contact with the membrane or the mesa at an off-center location with respect to the membrane or the mesa or both.

The mesa material, dimensions and pattern can be selected based on a set of target parameters. The target parameters can include one or more desired frequencies, powers (amplitudes), phases, vibrational patterns or any other physical parameter that can affect a physical property of the ultrasonic energy generated by the transducer. The driving signal can be a changing electrical potential applied through the electrodes to the actuator (such as a piezoelectric flexure) to produce the desired inputs to the transducer. The frequency of the ultrasonic energy generated by the transducer in response to the driving signal can be measured. If the frequency is below a desired frequency, the membrane system can be stiffened to raise the generated frequency. This can be done by altering the design of the membrane, the mesa or both. Likewise, if the generated frequency is too high, the membrane system may be made less stiff to lower the frequency.

The stiffness of the membrane system can be increased by increasing the size of the mesa component, increasing its thickness, changing the material or materials from which it is fashioned to a stiffer material, changing one or more attributes of the geometric shape of the mesa component, etc. For example, a single cross pattern is generally less stiff than the same cross with a circle connecting the four arms of the cross. In addition to or instead of changing the stiffness of the mesa component, its mass may also be changed. For example, if the frequency and/or the amplitude of the ultrasonic energy generated by the transducer are too high compared to a desired frequency and/or amplitude, then the mass of the mesa component can be increased to lower the generated frequency and amplitude. Keeping the mass of the overall mesa about the same and changing its disposition within the mesa can also change these parameters. For example, moving mass from the center of the mesa toward its periphery can actually increase amplitude and frequency. Moving the mass toward the center can have the opposite effect. Similarly, making the mesa stiffer in a mesa region more toward the center can decrease frequency, while making the mesa stiffer in a mesa region away from center can have the opposite effect. Thus, changing the distribution of both stiffness and mass in the mesa component can change the parameters of the transducer's generated ultrasonic energy to more closely match desired values. The stiffness and/or mass of a mesa component can be changed by using materials having different stiffness-to-mass ratios and/or by shaping the mesa component differently.

The surface displacement can be measured to determine how much of it is in phase. If there is a section vibrating out of phase, the modifications to the mesa can "tie" the out-of-phase section to the other sections to force more of the membrane system to remain in phase. For example, the mesa component can be redesigned to include an arm extending onto the formerly out-of-phase section, or include a continuous or grid-like portion to attach to the formerly out-of-phase section.

The mesa may be used to stiffen the combined mesa and membrane in a symmetrical manner, for example, with the mesa being centered on the membrane and having a symmetrical shape and mass distribution along one or more axis of symmetry through the center of the mesa. The mesa may also stiffen the combined mesa and membrane in an asymmetrical manner, for example, to compensate for an actuator that is in contact with mesa or membrane or at off-center location with respect to the mesa, membrane, or both. For example, when the actuator contacts the membrane at an off center location, it does so more to one side of the membrane than the other. The mesa may be less stiff on the side of the membrane at which the actuator makes contact and stiffer on at least part of the other side of the membrane. This can compensate for the additional stiffness introduced into the membrane system by the contact point of the actuator being more on one side of the membrane than the other.

The membrane system can be designed to cause the transducer to have a resonant response that is unimodal or multimodal within a given frequency band or range. A unimodal response has a single resonant frequency, whereas a multimodal response has multiple resonant frequencies. The resonances can be created at predetermined frequencies. For example, by structuring the mesa component in the shape of an H, the distal portions of the arms of the H are less stiff than the part of the H near the crossbar. This can result is two or more resonances of that can be tuned by designing the mesa specifically to achieve these resonances at given frequencies. For example, the stiffness and mass of the crossbar can be adjusted to change the properties of the secondary resonance to a desired value. A lower stiffness and/or mass can be used to lower the frequency of the secondary resonance. A higher stiffness and/or mass can be used to raise the secondary resonance frequency.

The membrane system may have an effective stiffness ranging from 0.1 kN/m to 30.0 MN/m and, in some applications, preferably 1 kN/m to 100 kN/m. Similarly the effective mass can range from 0.01 mg to 100 mg and in many applications preferably 0.1 mg to 5 mg The flexure may be designed with the same effective stiffness. The effective stiffness of the membrane system generally affects the frequency or frequency range generated by the system. For example, for an effective stiffness of about 30 kN/m for a given effective mass, frequencies on the order of 50 kHz may be generated. Frequencies higher or lower than 50 kHz may be generated by using a different effective stiffness. For example, an effective membrane stiffness of 8 kN/m with an effective mass of 0.8 mg can result in a frequency of around 17 kHz. For a further example, a membrane system and flexure having a higher effective stiffness could be used to generate a transducer frequency above 17 kHz. Likewise, a lower effective stiffness can result in a lower transducer frequency than 17 kHz. As used herein an effective stiffness refers to the overall stiffness of a component, which can be influenced not only by the choice of material for the component, but also on the geometric shape and properties of the component. For example, a short flexure can have a higher effective stiffness than a long flexure made of the same material. The effective stiffness (and mass) can be selected based upon design goals and/or restrictions. For example, if a less stiff flexure is desired, it can be made by lengthening the flexure. If there is insufficient physical space in the transducer to do so, the membrane system can be made less stiff. Similarly, if an aluminum membrane is replaced with Kapton, which is less stiff than aluminum, then the flexure can be shortened, thereby increasing its effective stiffness and keeping the frequency of the acoustic energy generated by the transducer the same. In other words, the combination of the flexure and the membrane system can determine the generated frequency.

Approximate values for a desired frequency in some combinations may be described using the following equations:

$$F_{out} \approx \sqrt{F_{flexure}^2 + F_{membrane\ system}^2}$$

where $$F_x = \frac{1}{2\pi}\sqrt{\frac{K_x}{M_x}}$$

and $F_{out}$ is the desired frequency, $F_x$ is the frequency of a component x, $M_x$ is the effective mass of the component, and $K_x$ is the effective stiffness of the component. A range of around 10 kN/m to 10 MN/m effective stiffness and 0.1 to 40 mg effective mass can be used in some implementations, and range of around 100 to 400 kN/m effective stiffness and 1 to 4 mg effective mass can be used as well. Thus, for example, an output frequency of 50 kHz may be achieved by using a flexure and membrane that has a combined effective stiffness of about 200 kN/m and an effective mass of 2 mg, or similarly an effective stiffness of 300 kN/m with an effective mass of 3 mg.

The effective mass of the combined flexure and membrane system for a transducer can be from 100 micrograms to 130 milligrams and preferably 0.5 to 15.0 milligrams, or can be from 0.75 mg to 5 mg. A heavier mass in any component (the mesa, the standoff, the membrane or the flexure) can lower the frequency generated by the transducer.

The parameters and characteristics disclosed herein can apply to a system having a membrane with a mesa or to a system having only a membrane without a mesa.

Some implementations may also include a standoff attached to a distal end of the actuator, or flexure. The actuator may be mechanically linked to the membrane through the standoff and the mesa. The standoff may displace at least part of the actuator away from the membrane so that the actuator doesn't slap or otherwise contact the membrane during vibration. Without the standoff, part of the flexure other than the intended contact point (e.g., at least part of the arm of the flexure) could contact the membrane during a downward stage of its vibration, thereby interfering with the ultrasonic transducer's generation of ultrasonic energy, resulting in the ultrasonic energy varying from the intended characteristics.

In an embodiment, the standoff can include an adhesive filled with beads or microspheres, that can hollow, solid, or coated. The beads can be fashioned of a rigid material, such as a glass, ceramic or hard metal, of a given diameter. For example, the beads may be glass beads having a diameter of 100 micrometers. The beads can be mixed or embedded in an adhesive, such as epoxy, creating a bead-filled or "loaded" adhesive. In an embodiment, a portion of the actuator can be fixed to the mesa by applying a layer of the filled adhesive to the mesa, the actuator, or both and pressing them together. The adhesive can spread to form a thinner and thinner layer until it reaches a thickness about equal to the diameter of the beads. The beads can act as a stop to the further thinning of the adhesive layer and create a standoff having a precise thickness. For example, with an epoxy filled with 100-micron glass beads, the standoff can be the 100-micron thick adhesive layer between the actuator and the mesa.

In other embodiments, the standoff may be a piece of material of a given thickness interposed between the actuator and the mesa or the actuator and the membrane. The piece of material may be bonded to the actuator, the mesa, the membrane or any combination thereof using any bonding technique, including the use of a filled or non-filled adhesive.

In an implementation, a standoff can be positioned at or around an end of an actuator such as a flexure. The end of the flexure may be mechanically linked to the mesa and the membrane through the standoff. When the flexure vibrates, the vibrations can be transmitted through the standoff to the membrane system causing to vibrate and generate ultrasonic waves.

Some embodiments can include several mesas on a membrane in a given pattern, such as a grid pattern, randomly or in accordance with a statistical distribution, such as a Gaussian or Poisson distribution. Each mesa may have a patterned shape. Some or all of the patterned shapes can be of the same or a different form and/or scale. Each of a number of actuators can be mechanically linked to one of the several mesas through a standoff. For example, a standoff can be attached at or around one end of one of the actuators, which may then be mechanically linked to one or more of the several mesas on the membrane. When there are multiple mesas on a membrane, some or all of the mesas can each be aligned with an actuator. The standoff of each actuator can contact one or more of the mesas such that the movement of one of the actuators moves the contacted mesa or mesas. The standoff can include a loaded or non-loaded epoxy or other adhesive (such as a cyanoacrylate) that bonds the actuator to the mesa. At least a part of the standoff can be any suitable shape, including a disc, a regular polyhedron, an irregular polyhedron, have a curved portion, be irregular, etc.

A transducer can include a container made of at least one wall element situated over a base. The container can be a cylinder, a box, a polyhedron or any suitable shape, whether regular or not. The membrane system can be positioned at one end of the container. The membrane system with at least one wall element and the base can be made to seal the container. The interior of the container can be maintained at a lower, higher, or the same atmospheric pressure as the ambient environment. A pressure other than ambient can pre-tension the membrane and improve its effectiveness of the transducer.

In various embodiments, the flexure can include a substrate, a piezoelectric or other electroactive layer and an electrode. The piezoelectric layer can be a thin film piezoelectric material or any other suitable piezoelectric material, such as PZT, PMN-PT, PVDF for example. The substrate can be made of a variety of materials including standard metals (brass, stainless steel, aluminum), composite materials (CFRP), or homogeneous polymer materials. The electrode can be made, for example, of screen-printed or vapor-deposited compatible conductive materials such as gold, platinum, alloys of those, along with other pure metals and alloys. The substrate, piezoelectric layer, and electrode can be configured in any suitable arrangement.

One of the wall elements can include two parts that can be electrically isolated from each other. One part of the wall element can be electrically connected to the electrode of the flexure and the second part can be electrically connected to the substrate. A control signal (the driving signal) can be conveyed through one or both of the parts of the wall element to the flexure. In response, the flexure can cause the membrane to vibrate at ultrasonic frequencies, thereby creating ultrasonic frequency acoustic waves.

FIG. 1 shows an embodiment of the disclosed subject matter that includes two ultrasonic transducers. The container 101 of one transducer 100 can be defined by base 102 and a wall element 103. The wall element 103 can have an upper part 104 and a lower part 105. The upper part 104 can be electrically connected to an electrode portion of a flexure 106*a* having a standoff 106*b*, which may be an electrostrictive actuator, a piezoelectric actuator, or an actuator that includes both electrostrictive and piezoelectric components. The lower part 105 can be electrically connected to a substrate or electrode of the flexure 106*a*. The top of the container can be sealed by a membrane 107. Mesa 108 can be provided in conjunction with the membrane 107. The flexure 106*a* can be in mechanical contact with the stiffener 108. A control signal can be fed to the flexure 106*a* such as via the upper part 104 and/or the lower part 105 of the wall element 103.

Figure 2:
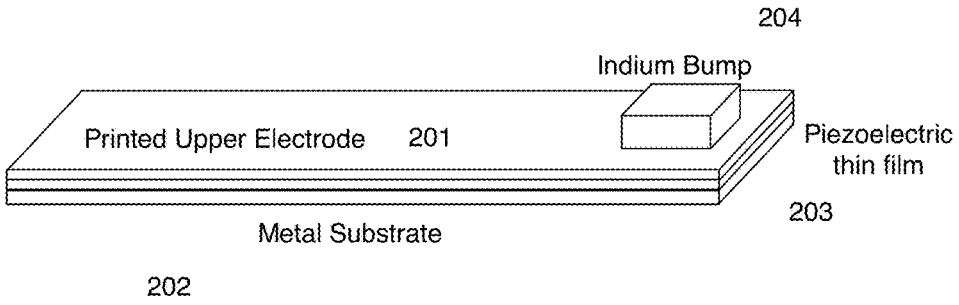
FIG. 2 shows a flexure type actuator according to an implementation of the disclosed subject matter.

FIG. 2 shows an embodiment of a flexure. The flexure may include an upper electrode 201 and a metal substrate 202 with a piezoelectric material 203 disposed between the electrode 201 and the metal substrate 202. Substrate 202 may also be a second electroactive layer. A standoff 204 can be fixed toward one end of the flexure to facilitate the flexure's mechanical communication with the mesa 108 and/or membrane 107.

Figure 3:
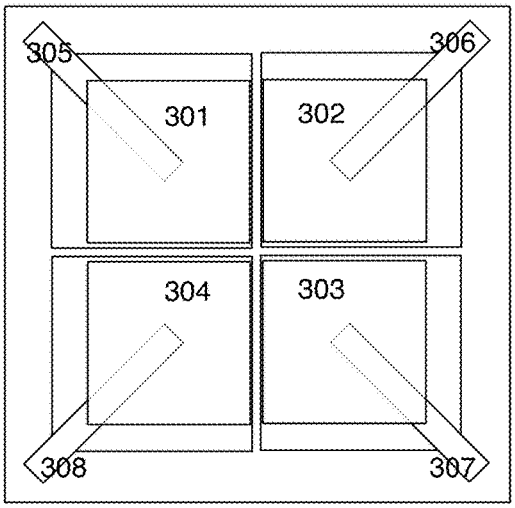
FIG. 3 shows an ultrasonic transducer configuration according to an implementation of the disclosed subject matter.

FIG. 3 shows the configuration of an embodiment of four transducers, 301, 302, 303 and 304. Flexures 305, 306, 307 and 308 extend from corners of the transducers. The flexures can be placed at an arbitrary angle (e.g., other than normal) in relation to the transducer wall to accommodate a flexure of a given length. The tip displacement of a flexure can be a function of its length. The frequency of oscillation of a flexure can be a function of its length. Output acoustic pressure can be a function of diaphragm displacement. That is, the more the diaphragm moves at a given frequency, the more pressure can be created in the air.

In yet another embodiment, a single container can include more than one membrane. Each of the membranes can be powered by a separate flexure. For example, a flexure could be fixed to a wall location and be in mechanical communication not necessarily with the closest membrane to the wall location, but with a membrane that is more distant from the wall location. For example, in FIG. 3, the four transducers may be modified into a single container with four membranes, each membrane at a location 301, 302, 303 and 304. Flexure 305 can be in mechanical contact with membrane 303 rather than membrane 301, thereby lengthening flexure 305. The other flexures can be arranged similarly. A crossing point of one flexure with another can be managed by forming one flexure to pass underneath or over the other, thereby preventing them from interfering with each other in operation. The vacuum of the container can avoid acoustic interference within the single container between different flexures and membranes.

Figure 4:
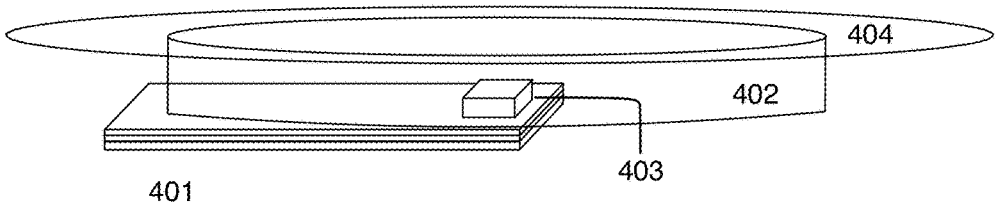
FIG. 4 shows a flexure in communication with a membrane according to an implementation of the disclosed subject matter.

FIG. 4 shows flexure 401 in mechanical communication with a mesa 402 through standoff 403. The mesa 402 may be in mechanical communication with the membrane 404. Movement of the flexure 401, for example, due to the application of a varying electric field to a piezoelectric material in the flexure 401, may result in movement of the mesa 402 through contact with the standoff 403. As the mesa 402 may be mechanically linked to the membrane 404, movement of the mesa 402 may result in movement of the membrane 404. The membrane 404 may move upwards when the mesa 402 moves upwards, and may be pulled downwards when the mesa 402 is pulled downwards by the flexure 401.

Figure 5:
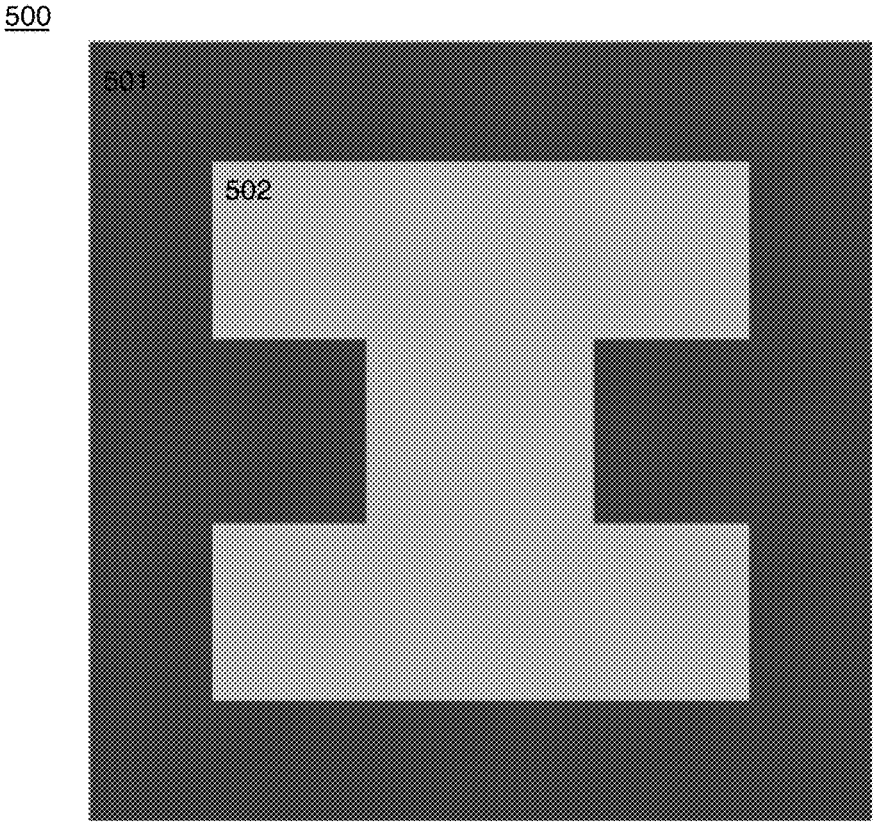
FIG. 5 shows an example mesa according to an implementation of the disclosed subject matter.

FIG. 5 shows an example mesa according to an implementation of the disclosed subject matter. A membrane 501 for use with an ultrasonic transducer may be made of any suitable material, and may include an attached mesa 502. The mesa 502 may be made of any suitable material, and may be in any suitable shape, such as, for example, an "H" shape. For example, the membrane 501 may be made of polyimide, such as Kapton, and the mesa 502 may be made of copper. The membrane 501 and mesa 502 may form a membrane/mesa combination 500, which may be used to cover a container, for example, the container 101, for an ultrasonic transducer.

The "H" shape of the mesa 502 may result in an appropriate stiffness and mass of the membrane/mesa combination 500, resulting in ultrasonic transducer generating ultrasound at a desired frequency and amplitude. The "H" shape of the mesa 502 may also introduce an additional mode of resonance at a higher frequency, for example, around 100 kHz, that may be used, for example, for communication and imaging. The additional mode of resonance may be 180 degrees out of phase with the main 50 kHz ultrasound generated by the ultrasonic transducer, allowing the higher frequency mode to be used without interfering with the main 50 kHz mode. The frequency of the additional mode of resonance may be altered by, for example, altering the width of the crossbar of the "H" shape of the mesa 502.

The pattern of a mesa, such as the "H" shaped mesa, 502 may also influence the beam pattern of ultrasound generated by the ultrasonic transducer. The beam pattern may be the amplitude of sound pressure at a given distance from the ultrasonic transducer as it varies with angle from a line perpendicular to the ultrasonic transducer. The pattern may cause differing response in the x and y planes, and may be used to maintain pressure in the z axis, steer the ultrasound at a preset angle, or to compensate for a bias in the ultrasonic transducer, introduced, for example, by an electrostrictive or piezoelectric actuator, by stiffening specific areas of the membrane/mesa combination 500 to ensure the propagation of ultrasound in a direction normal to the surface of the ultrasonic transducer. Different patterns may be used for the mesa 502 may also alter the frequency of operation of the ultrasound transducer.

Figure 6:
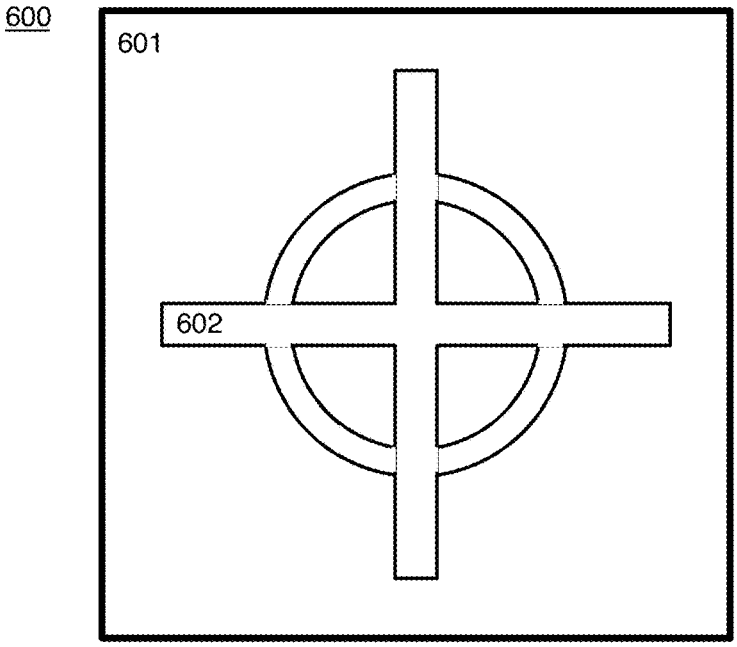
FIG. 6 shows an example mesa according to an implementation of the disclosed subject matter.

FIG. 6 shows an example mesa according to an implementation of the disclosed subject matter. A membrane 601 for use with an ultrasonic transducer may be made of any suitable material, and may include an attached mesa 602. The mesa 602 may be made of any suitable material, and may be in any suitable shape, such as, for example, a circle with a cross shape. For example, the membrane 601 may be made of polyimide, such as Kapton, and the mesa 602 may be made of copper. The membrane 601 and mesa 602 may form a membrane/mesa combination 600, which may be used to cover a container, for example, the container 101, for an ultrasonic transducer.

The cross shaped portion of the mesa 602 may increase the stiffness of the membrane/mesa combination 600, while the circle shaped portion of the mesa 602 may increase the proportion of the membrane system that is vibrating in phase. The mesa 602 may be centered on the membrane 601, with the center of the circle portion of the mesa 602 being at the center of the membrane 601. In some implementations, the membrane 601 may include aluminum, and may be, for example, solid aluminum. The mesa 602 may be cross shaped and made of a copper. This may optimize frequencies of operation and improve output amplitude for the ultrasonic transducer. In other words, changing the shape (e.g., contours, thickness, size, etc.) and/or material(s) used in the mesa can increase or decrease the frequency of operation.

The foregoing description, for purpose of explanation, has been described with reference to specific implementations. However, the illustrative discussions above are not intended to be exhaustive or to limit implementations of the disclosed subject matter to the precise forms disclosed. Many modifications and variations are possible in view of the above teachings. The implementations were chosen and described in order to explain the principles of implementations of the disclosed subject matter and their practical applications, to thereby enable others skilled in the art to utilize those implementations as well as various implementations with various modifications as may be suited to the particular use contemplated.

Figure 7:
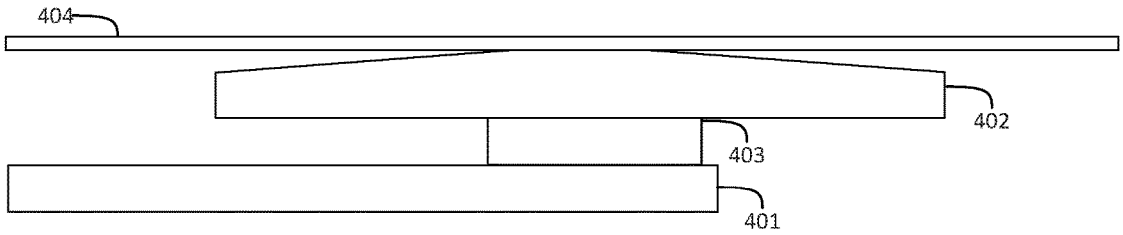
FIG. 7 shows an example flexure in communication with a membrane and a mesa according to an implementation of the disclosed subject matter.

FIG. 7 shows an example flexure in communication with a membrane and a mesa according to an implementation of the disclosed subject matter. The mesa 402 may have a varying thickness. For example, the mesa 402 may be thicker towards its middle, and may taper towards its edges.

The invention claimed is:

1. An apparatus comprising:

a membrane system comprising:

a membrane; and a mesa attached to the membrane and configured to modulate vibration of the membrane, the mesa comprising a material having a patterned shape; and an actuator mechanically linked to the membrane system at a first end of the actuator and to a wall element of a container at a second end of the actuator, the first end of the actuator comprising a distal end.

2. The apparatus of claim 1, wherein the actuator comprises piezoelectric material.

3. The apparatus of claim 1, wherein the actuator comprises an electrostrictive material.

4. The apparatus of claim 1, wherein the actuator is mechanically linked to the membrane through the mesa.

5. The apparatus of claim 1, further comprising a standoff disposed between the actuator and the mesa or membrane.

6. The apparatus of claim 5, wherein the standoff comprises an adhesive filled with beads.

7. The apparatus of claim 5, wherein the standoff comprises a material having a shape of at least one from the group of: a disc, an ellipse, a regular polyhedron, an irregular polyhedron, a curved portion and an irregular portion.

8. The apparatus of claim 1, wherein the membrane comprises a first material type and wherein the material having a patterned shape of the mesa comprises a second material type.

9. The apparatus of claim 8, wherein the first material type is aluminum and the second material type is copper.

10. The apparatus of claim 8, wherein the first material type is polyimide film and wherein the second material type is copper.

11. The apparatus of claim 8, wherein the first material type and the second material type are the same material type.

12. The apparatus of claim 8, wherein the first material type is a polymer and wherein the second material type is a metal.

13. The apparatus of claim 1, wherein the membrane or the mesa is comprised of at least one material selected from the group of aluminum, a polymer, copper, stainless steel, brass, diamond, sapphire, titanium, a covalently bonded ceramic or crystal, or a metal alloy.

14. The apparatus of claim 1, wherein the patterned shape of the mesa includes an H shape.

15. The apparatus of claim 1, wherein the patterned shape of the mesa includes an annulus.

16. The apparatus of claim 1, wherein the patterned shape of the mesa includes a circular shape.

17. The apparatus of claim 1, wherein the patterned shape of the mesa includes a cross.

18. The apparatus of claim 1, wherein the patterned shape of the mesa includes a torus.

19. The apparatus of claim 1, wherein the patterned shape of the mesa includes a torus and a cross.

20. The apparatus of claim 1, wherein the patterned shape is selected to achieve a target frequency.

21. The apparatus of claim 1, wherein the patterned shape is selected based on at least one target property of ultrasound that is generated by the apparatus.

22. The apparatus of claim 21, wherein the at least one property is selected from the group consisting of: power, phase, frequency and beam pattern.

23. The apparatus of claim 1, wherein the mesa has varying thicknesses.

24. The apparatus of claim 1, wherein the membrane system has an effective stiffness ranging from 0.1 kN/m to 30.0 MN/m.

25. The apparatus of claim 1, wherein the membrane system has an effective stiffness ranging from 100 kN/m to 1 MN/m.

26. The apparatus of claim 1, wherein the membrane system has an effective mass of from 100 micrograms to 130 milligrams.

27. The apparatus of claim 1, wherein the membrane system has an effective mass of from 0.1 mg to 5 mg.

28. The apparatus of claim 1, wherein the membrane system has an effective mass of from 0.75 mg to 5 mg.

29. The apparatus of claim 5, wherein the standoff is comprised of an epoxy filled with beads.

30. The apparatus of claim 1, wherein a portion of the piezoelectric actuator is in mechanical contact with a portion of the mesa or membrane substantially at the center of the membrane.

31. The apparatus of claim 1, wherein a portion of the piezoelectric actuator is in mechanical contact with a portion of the mesa or membrane at an off-center location of the membrane.

32. The apparatus of claim 1, wherein the mesa has a non-uniform stiffness.

33. The apparatus of claim 5, wherein the standoff comprises a material having a shape including at least one from the group of: a disc, an ellipse, a regular polyhedron, an irregular polyhedron, a torus, a curved portion and an irregular portion.

* * * * *